United States Patent [19]

Kawaguchi et al.

[11] 4,394,441

[45] Jul. 19, 1983

[54] PHOTOGRAPHIC SENSITIVE MATERIALS

[75] Inventors: Hideo Kawaguchi, Minami-ashigara; Takayuki Inayama, Fujinomiya; Masaaki Takimoto, Tokyo; Yoshihiro Ono, Asaka, all of Japan

[73] Assignee: Fuji Photo Film Co., Ltd., Kanagawa, Japan

[21] Appl. No.: 339,798

[22] Filed: Jan. 15, 1982

[30] Foreign Application Priority Data

Jan. 14, 1981 [JP] Japan ..... 56-4442

[51] Int. Cl.[3] ..... G03C 1/84

[52] U.S. Cl. ..... 430/524; 430/526; 430/527; 430/530

[58] Field of Search ..... 430/63, 524, 526, 527, 430/530, 531, 533, 539

[56] References Cited

U.S. PATENT DOCUMENTS

| | | | |
|---|---|---|---|
| 3,245,833 | 4/1966 | Trevoy | 430/63 |
| 3,864,132 | 2/1975 | Rasch et al. | 430/524 |
| 3,874,878 | 4/1975 | Rasch et al. | 430/526 |
| 3,874,879 | 4/1975 | Rasch | 430/524 |

*Primary Examiner*—Mary F. Downey

*Attorney, Agent, or Firm*—Sughrue, Mion, Zinn, Macpeak and Seas

[57] ABSTRACT

A photographic sensitive material is described comprising at least one photographic sensitive layer provided on a plastic film base through a subbing layer, wherein the improvement comprises said subbing layer containing fine particles of at least one electrically conductive crystalline metal oxide selected from ZnO, $TiO_2$, $SnO_2$, $Al_2O_3$, $In_2O_3$, $SiO_2$, MgO, BaO, and $MoO_3$, or a compound oxide thereof having a volume resistivity of $10^7$ Ω cm or less.

12 Claims, No Drawings

PHOTOGRAPHIC SENSITIVE MATERIALS

FIELD OF THE INVENTION

The present invention relates to photographic sensitive materials, and particularly, to photographic sensitive materials having an excellent antistatic property.

BACKGROUND OF THE INVENTION

Photographic sensitive materials (hereinafter referred to simply as "sensitive material") are generally produced by providing a subbing layer on a plastic film base and applying photographic sensitive layers (hereinafter referred to simply as "sensitive layers") to the subbing layer.

In recent years, techniques for producing sensitive materials have been remarkably improved; for example, the coating speed for the subbing layer, coating speed for the sensitive layer, and cutting speed have been remarkably increased. Consequently, static electricity tends to be easily generated in such steps of production.

Further, high speed is required for photographing and for development processing, too. In these steps, static electricity also tends to be generated.

The generation of static electricity can be a very serious problem, because not only does dust stick to the sensitive layer due to the generation of static electricity, but spark discharge may also occur, and consequently, so-called static marks are formed on the sensitive layer.

Hitherto, in order to prevent charging of the sensitive materials, polymeric electrolytes or ionic surface active agents have generally been used. For example, as anionic polymeric electrolytes, there are high molecular substances containing carboxylic acid, carboxylic acid salt or sulfonic acid salt as described in, for example, Japanese Patent Application (OPI) No. 22017/73 (the term "OPI" as used herein refers to a "published unexamined Japanese patent application"), Japanese Patent Publication 24159/71 and Japanese Patent Application (OPI) Nos. 30725/76, 129216/76 and 95942/80. Examples of cationic polymeric electrolytes include substances described, for example, in Japanese Patent Application (OPI) Nos. 121523/74 and 91165/73 and Japanese Patent Publication No. 24582/74. Useful ionic surface active agents include both anionic and cationic types. Examples thereof include compounds described in Japanese Patent Application (OPI) Nos. 85826/74 and 33630/74, U.S. Pat. Nos. 2,992,108 and 3,206,312, Japanese Patent Application (OPI) No. 87826/73, Japanese Patent Publication Nos. 11567/74 and 11568/74 and Japanese Patent Application (OPI) No. 70837/80, etc.

However, these compounds generally cause deterioration of adhesion between the base and the subbing layer, or between the subbing layer and the emulsion layer, and they often cause trouble of adhesion when the subbing layer and the subbing layer or the snubbing layer and the emulsion layer are brought into contact with each other, because of having a high hygroscopic property. Further, the antistatic properties of these substances have a large humidity dependence, and many of them do not function satisfactorily at low humidity.

SUMMARY OF THE INVENTION

A first object of the present invention is to provide sensitive materials having an excellent antistatic properties.

A second object of the invention is to provide sensitive materials comprising an antistatic subbing layer which does not damage the adhesion between a hydrophilic colloid layer, such as the sensitive layer, etc., and the base.

A third object of the invention is to provide sensitive materials comprising an antistatic layer which does not cause problems due to adhesion even if it is brought into contact with another subbing layer or emulsion layer at high humidity.

A fourth object of the invention is to provide sensitive materials comprising an antistatic layer having no humidity dependence.

These objects of the present invention are attained by providing a photographic sensitive materials comprising at least one photographic sensitive layer provided on a plastic film base through a subbing layer, wherein the improvement comprises said subbing layer contains fine particles of at least one electrically conductive crystalline metal oxide selected from ZnO, $TiO_2$, $SnO_2$, $Al_2O_3$, $In_2O_3$, $SiO_2$, MgO, BaO and $MoO_3$, or a compound oxide (including double oxides) thereof having a volume resistivity of $10^7$ Ω cm or less.

DETAILED DESCRIPTION OF THE INVENTION

Fine particles of electrically conductive crystalline metal oxides or compound oxides thereof used in the present invention have a volume resistivity of $10^7$ Ω cm or less, and preferably $10^5$ Ω cm or less. The particle size (i.e., largest cross-sectional dimension) of them is generally from 0.01 to 0.7μ, and preferably from 0.02 to 0.5μ.

Processes for producing fine particles of electrically conductive crystalline metal oxides and compound oxides thereof have been described in detail in Japanese Patent Applixation (OPI) No. 143430/81 (which corresponds to U.S. patent application Ser. No. 253,499 filed on Apr. 13, 1981; British Patent Application No. 8111286 (published as Ser. No. 2,075,208 A); and West German Patent Application P 31 14 627.9). It is easy to carry out: firstly, by a process which comprises producing fine particles of metal oxide by sintering metal (e.g., Zn, Sn) and processing fine particles of the matrix-forming metal oxide by a heat treatment in the presence of hetero-atoms (dopants) which improve electrical conductivity; secondly, by a process which comprises producing fine particles of metal oxide by sintering metal oxide (e.g., ZnO, $SnO_2$) in the presence of hetero-atoms (dopants) for improving electrical conductivity; and thirdly, by a process which comprises producing fine particles of metal oxides by sintering while using a reduced oxygen content in the atmosphere in order to introduce oxygen defects. Examples of the hetero-atoms (dopants) include Al, In, Ni, Co, Fe, Cr, etc., for ZnO; Nb, Ta, etc., for $TiO_2$; and Sb, Nb, In, halogen atoms, etc., for $SnO_2$. In general, a combination of a metal oxide and a dopant which has one lower or higher valence than that of the metal of said metal oxide [e.g., a combination of ZnO ($Zn^{2+}$) with Al ($Al^{+3}$), In ($In^{+3}$), Ni ($Ni^{+3}$), Co ($Co^{+3}$), Fe ($Fe^{+3}$) or Cr ($Cr^{+3}$); and a combination of $SnO_2$ ($Sn^{4+}$) with Sb ($Sb^{3+}$ or $Sb^{+5}$), Nb ($Nb^{+5}$) or In ($In^{+3}$)] is preferred. The hetero-atom content is generally in the range of from 0.01 to 30 mol%, and preferably from 0.1 to 10 mol%.

In order to apply the electrically conductive fine particles in a subbing layer, it is possible to utilize a process which comprises dispersing the fine particles in a binder of the subbing layer, applying the dispersion directly onto a base, and applying an emulsion onto the resulting subbing layer. Alternatively, a hydrophilic polymer such as gelatine can be applied onto the resulting subbing layer, and then applying an emulsion layer. Also, a process may be used which comprises processing the base by a surface treatment (such as corona discharging, ultraviolet ray treatment, glow-discharge treatment, solvent treatment, or polymer application, etc.), applying a dispersion of fine particles without a binder onto the surface treated base, applying a hydrophilic polymer such as gelatine onto the resulting subbing layer, and then applying an emulsion onto the resulting hydrophilic polymer layer. Alternatively, a dispersion of fine particles in a binder can be applied onto the surface treated base, and then applying an emulsion layer thereon. Further, if desired, after applying a dispersion of fine particles in a binder onto the surface treated base, a hydrophilic polymer such as binder may be applied thereon, and then applying an emulsion layer. Although the objects of the present invention can be attained by utilizing any of the above described processes, processes including surface treatment of the base are particularly preferred.

Examples of the binder of the subbing layer include latex polymers, water soluble polymers, cellulose esters, soluble polyesters, etc.

Examples of the latex polymers include latexes of vinyl chloride copolymers, vinylidene chloride copolymers, glycidyl acrylate copolymers, glycidyl methacrylate copolymers, alkyl acrylate copolymers, vinyl acetate copolymers, butadiene copolymers, etc. Specifically, examples thereof include latexes described in Japanese Patent Application (OPI) Nos. 135526/76, 43911/75, 114120/76 and 121323/76, Japanese Patent Publication No. 14434/73 and Japanese Patent Application (OPI) 112677/77. Examples of the water soluble polymers include gelatine, gelatine derivatives, maleic acid anhydride copolymers such as vinyl acetate-maleic acid anhydride copolymer, etc. Examples of the cellulose esters include cellulose acetate, cellulose acetate butyrate, nitrocellulose, etc. Examples of soluble polyesters include those described in Japanese Patent Application (OPI) No. 1612/79 and Japanese Patent Publication Nos. 2529/69, 10432/60, etc.

Examples of solvents useful for preparing a dispersion of electrically conductive fine particles of the present invention include water, alcohols such as methanol, ethanol, and propanol, ketones such as acetone, methyl ethyl ketone, and methyl isobutyl ketone, esters such as methyl acetate and ethyl acetate, glycol ethers such as methyl cellosolve, ethyl cellosolve, and dioxane, chlorinated hydrocarbons such as methylene dichloride and ethylene dichloride, phenols such as phenol, cresol, and resorcinol, and acetic acids such as monochloroacetic acid, trichloroacetic acid, and unsubstituted acetic acid.

In the present invention, if the ratio of the electrically conductive fine particles to the binder is very small, the antistatic property tends to deteriorate. On the other hand, if the ratio of the electrically conductive fine particles to the binder is very large, adhesion between the sensitive layer and the base deteriorates. Although the optimum mixing ratio of the electrically conductive fine particles to the binder varies according to the particle size, it is generally preferred that the volume content of the electrically conductive fine particles is in a range of from 5 to 75%, and preferably from 10 to 70%, of the volume of the subbing layer. The area concentration of the electrically conductive particles to be used is preferably in a range of from 0.05 $g/m^2$ to 20 $g/m^2$, and more preferably from 0.1 $g/m^2$ to 10 $g/m^2$.

As the base for the photographic sensitive materials of the present invention, it is possible to use, for example, cellulose triacetate, cellulose acetate butyrate, cellulose acetate propionate, polyethylene terephthalate, polyethylene naphthalate, polycarbonate, polystyrene, polyethylene, polypropylene, etc., and laminates thereof.

Further, the layer containing fine particles of metal oxide according to the present invention may also contain coating assistants (for example, saponin or dodecylbenzenesulfonic acid), hardening agents, and other conventional additives.

The sensitive materials of the present invention may also include, if desired or necessary, an intermediate layer, a back layer, a surface protective layer, an image receiving layer, etc., in addition to at least one sensitive layer on the subbing layer.

Examples of the sensitive layer include conventional photosensitive silver halide emulsion layers. There are no particular restrictions with respect to the kind of silver halide used in the silver halide emulsion layer, the process for producing it, and chemical sensitizers, antifogging agents, surface active agents, protective colloids, hardeners, polymer latexes, color couplers, and sensitizing dyes that can be used, and examples thereof are described in *Research Disclosure,* Vol. 176, pages 22–28 (December 1978).

Further, there are no particular restrictions with respect to the intermediate layer, the back layer, the surface protective layer, etc., which may contain various additives as described in the abovementioned description in *Research Disclosure.*

Moreover, there are no particular restrictions with respect to the methods of applying each coating layer, and methods referred to in the aforementioned description in *Research Disclosure* can be used.

Typical examples of the sensitive materials of the present invention include silver halide color films, direct and indirect X-ray films, lithographic films, conventional black-and-white films, etc.

Below, the present invention is illustrated by reference to examples. In the examples, all parts are by weight.

EXAMPLE 1

230 parts of stannic chloride hydrate and 23 parts of antimony trichloride were dissolved in 3000 parts of ethanol to obtain a homogeneous solution. To the resulting solution a 1 N aqueous solution of sodium hydroxide was added dropwise so that the pH of the solution became 3, by which a co-precipitate of colloidal stannic oxide and antimony oxide was obtained. The resulting co-precipitate was allowed to remain at 50° C. for 24 hours to obtain a reddish brown colloidal precipitate.

The reddish brown colloidal precipitate was separated by centrifugal separation. In order to remove excess ions in solution, water was added to the precipitate and washing was carried out by centrifugal separation. This operation was repeated three times to remove the excess ions.

200 parts of the colloidal precipitate from which excess ions were removed were dispersed again in 1500 parts of water, and the resulting dispersion was atomized in a calcination furnace heated to 600° C. to obtain a fine bluish powder of tin oxide-antimony oxide compound having an average particle size of 0.2μ. This fine powder had a specific resistance of 25 Ω-cm.

A mixture composed of 10 parts of the above described fine powder and 100 parts of water was processed by a paint shaker (produced by Toyo Seiki Seisakusho Co.) for 1 hour. Using the resulting dispersion, a subbing solution having the following composition was prepared.

| | |
|---|---|
| Dispersion of fine particles | 100 parts |
| SBR latex* (solid content: 40 wt %) | 4 parts |
| Sodium salt of 2,4-dichloro-6-hydroxy-s-triazine (5% aqueous solution) | 2 parts |

*Styrene-butadiene copolymer (Hycar LX, produced by Nippon Geon Co., Ltd.)

This subbing solution was applied to a polyethylene terephthalate base having a thickness of 100μ which was subjected to corona discharge treatment so that a dried coating amount was 1 g/m$^2$, and dried for 5 minutes at 150° C.

When the surface resistivity of the resulting subbing layer was measured by an insulation resistance tester (Type VE-30 produced by Kawaguchi Denki Co.), it was $5\times10^6$ Ω at 25° C. and 60% RH and $3\times10^6$ Ω at 25° C. and 25% RH, and no increase in surface resistivity at low humidity was observed.

To this layer, gelatin was applied so that the dried coating amount was 0.3 g/m$^2$, and an indirect X-ray sensitive silver halide photographic emulsion was applied so as to have a thickness of 5μ. The resulting emulsion layer had a surface resistivity of $6\times10^{10}$ Ω.

In order to examine the adhesive strength between the base and the emulsion layer, the emulsion layer was scratched by a razor so as to form scratch lines of about 5 m/m so that 25 squares were formed. A polyester tape produced by Nitto Co. was adhered thereto and then stripped away roughly. However, the emulsion layer was not separated.

EXAMPLE 2

A solution having the following composition was applied to a cellulose triacetate base having a thickness of 125μ (coating amount: dry weight of 0.5 g/m$^2$) to form a subbing layer.

| | |
|---|---|
| Gelatin | 1 part |
| Water | 1 part |
| Acetic acid | 1 part |
| Methanol | 40 parts |
| Methylene dichloride | 40 parts |
| Acetone | 20 parts |

To the resulting subbing layer, a solution having the following composition was applied so that the dry weight was 0.7 g/m$^2$.

| | |
|---|---|
| Dispersion of electrically conductive fine particles as in Example 1 | 60 parts |
| Gelatine | 1 part |
| Water | 20 parts |
| Methanol | 20 parts |

-continued

| | |
|---|---|
| Sodium salt of 2,4-dichloro-6-hydroxy-s-triazine (5% aqueous solution) | 1 part |

When the surface resistivity of this layer was measured by the same tester as in Example 1, it was $1\times10^6$ Ω at 25° C. and 50% RH and $9\times10^5$ Ω at 25° C. and 25% RH. The surface resistivity did not increase at low humidity.

On the other hand, in case of applying only gelatin which did not contain the electrically conductive fine particles, the layer showed a high resistivity of $8\times10^{13}$ Ω at 50% RH and $5\times10^{14}$ Ω at 25% RH.

A color negative photographic emulsion was applied to the subbing layer containing the fine particles. When the adhesive strength between the base and the photographic emulsion layer of the resulting film was examined in the same manner as in Example 1, there was no separation.

EXAMPLE 3

A solution having the following composition was applied to a polyethylene terephthalate film having a thickness of 175μ so that the dry weight was 0.5 g/m$^2$, and dried at 150° c. for 3 minutes.

| | |
|---|---|
| Vinylidene chloride type latex* | 6 parts |
| Resorcinol | 3 parts |
| Water | 95 parts |

*Vinylidene chloride-ethyl acrylate-acrylic acid copolymer (copolymerization ratio: 85:15:5) latex having a solid content of 25% by weight.

Further, to the resulting layer, a solution having the following composition was applied so that the dry weight was 0.6 g/m$^2$, and dried at 110° C. for 5 minutes.

| | |
|---|---|
| Dispersion of fine particles as in Example 1 | 50 parts |
| Gelatin | 1 part |
| Distilled water | 50 parts |
| Saponin | 0.01 part |
| Sodium salt of 2,4-dichloro-6-hydroxy-s-triazine (5% aqueous solution) | 1.5 parts |

The surface resistivity was $5\times10^6$ Ω at 25° C. and 60% RH and $3\times10^6$ Ω at 25° C. and 25% RH, and the surface resistivity did not increase at low humidity.

EXAMPLE 4

| | |
|---|---|
| Zinc oxide | 100 parts |
| 10% aqueous solution of $Al(NO_3)_3.9H_2O$ | 5 parts |
| Water | 100 parts |

A mixture composed of the above described composition was processed by applying ultrasonic waves for 10 minutes to prepare a homogeneous dispersion. After the resulting dispersion was dried at 110° C. for 1 hour, it was calcined at $1\times10^{-4}$ Torr and 600° C. for 5 minutes to obtain zinc oxide having a specific resistance of $2\times10^2$ Ω-cm. The average particle size was 2μ. These particles were powdered by a ball mill to obtain particles having an average particle size of 0.7μ.

| | |
|---|---|
| The resulting ZnO powder | 10 parts |

-continued

| | |
|---|---|
| Water | 150 parts |

A mixture composed of the above described composition was dispersed by a paint shaker for 1 hour to obtain a homogeneous dispersion. This dispersion was subjected to centrifugal separation at 1000 rpm for 30 minutes to remove coarse particles. The residual supernatant fluid was removed by centrifugal separation at 2000 rpm for 1 hour to obtain a ZnO paste composed of fine particles.

10 parts of the above described ZnO paste were mixed with 10 parts of a 10% aqueous solution of gelatin and 80 parts of water and dispersed by a paint shaker for 1 hour to prepare an electrically conductive coating solution.

The resulting coating solution was applied to a polyethylene coated paper subjected to corona discharge treatment so as to be 20 cc/m$^2$ and dried at 120° C. for 2 minutes. The resulting layer had a surface resistance of $3\times10^8\ \Omega$. Further, a photographic emulsion for color printing paper was applied to the resulting layer to obtain color paper.

While the invention has been described in detail and with reference to specific embodiments thereof, it will be apparent to one skilled in the art that various changes and modifications can be made therein without departing from the spirit and scope thereof.

What is claimed is:

1. A photographic sensitive material comprising at least one silver halide sensitive layer provided on a plastic film base through a subbing layer, wherein the improvement comprises said subbing layer containing fine particles of at least one electrically conductive crystalline metal oxide selected from ZnO, $TiO_2$, $SnO_2$, $Al_2O_3$, $In_2O_3$, $SiO_2$, MgO, BaO, and $MoO_3$, or a compound oxide thereof having a volume resistivity of $10^7$ $\Omega$ cm or less, dispersed in an organic polymer binder.

2. A photographic sensitive material as in claim 1, wherein the volume resistivity of the particles is $10^5\ \Omega$ cm or less.

3. A photographic sensitive material as in claim 1 or 2, wherein the particle size is from 0.01 to 0.7$\mu$.

4. A photographic sensitive material as in claim 1 or 2, wherein the particle size is from 0.02 to 0.5$\mu$.

5. A photographic sensitive material as in claim 1 or 2, wherein the electrically conductive fine particles constitute from 5 to 75% of the volume of the subbing layer and have an area concentration of from 0.05 g/m$^2$ to 20 g/m$^2$.

6. A photographic sensitive material as in claim 1 or 2, wherein the electrically conductive fine particles constitute from 10 to 70% of the volume of subbing layer and have an area concentration of from 0.1 g/m$^2$ to 10 g/m$^2$.

7. A photographic sensitive material as in claim 3, wherein the electrically conductive fine particles constitute from 5 to 75% of the volume of the subbing layer and have an area concentration of from 0.05 g/m$^2$ to 20 g/m$^2$.

8. A photographic sensitive material as in claim 3, wherein the electrically conductive fine particles constitute from 10 to 70% of the volume of subbing layer and have an area concentration of from 0.1 g/m$^2$ to 10 g/m$^2$.

9. A photographic sensitive material as in claim 1, wherein the metal oxide is ZnO, $TiO_2$ or $SnO_2$.

10. A photographic sensitive material as in claim 1, wherein said subbing layer is formed by coating a dispersion of the at least one electrically conductive crystalline metal oxide, the organic polymer binder and a solvent.

11. A photographic sensitive material as in claim 1, wherein the volume content of the at least one electrically conductive fine particle is from 5 to 75% of the volume of the subbing layer.

12. A photographic sensitive material as in claim 1, wherein said subbing layer consists essentially of the at least one electrically conductive crystalline metal oxide and the organic polymer binder.

* * * * *